US006647587B1

(12) United States Patent
Ohara et al.

(10) Patent No.: US 6,647,587 B1
(45) Date of Patent: Nov. 18, 2003

(54) VACUUM CLEANER USING CENTRIFUGAL FORCE DUST COLLECTION TO PREVENT FILTER BLINDING

(75) Inventors: Naoyuki Ohara, Shiga (JP); Saburo Kajikawa, Shiga (JP); Tomonori Kato, Shiga (JP); Hiroshi Mori, Shiga (JP); Kouichi Ito, Shiga (JP); Shin Yoshida, Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 246 days.

(21) Appl. No.: 09/630,698

(22) Filed: Aug. 1, 2000

(30) Foreign Application Priority Data

Aug. 2, 1999 (JP) ..... 11-218639

(51) Int. Cl.[7] ..... A47L 9/16

(52) U.S. Cl. ..... 15/350; 15/346; 15/351; 15/352; 15/353; 55/DIG. 3; 55/459.1

(58) Field of Search ..... 15/346, 350, 351, 15/352, 353; 55/DIG. 3, 459.1

(56) References Cited

U.S. PATENT DOCUMENTS 4,377,882 A * 3/1983 Dyson ..... 15/346
4,884,315 A * 12/1989 Ehnert ..... 15/346
5,014,388 A * 5/1991 Schiazza et al. ..... 15/351
5,020,186 A * 6/1991 Lessig, III et al. ..... 15/351
5,160,356 A * 11/1992 Dyson ..... 55/DIG. 3
5,230,722 A * 7/1993 Yonkers ..... 15/353
5,267,371 A * 12/1993 Soler et al. ..... 15/353
5,307,538 A * 5/1994 Rench et al. ..... 55/DIG. 3
5,647,092 A * 7/1997 Miwa ..... 15/346
6,003,196 A * 12/1999 Wright et al. ..... 15/353
6,032,327 A * 3/2000 Oka et al. ..... 15/346
6,141,826 A * 11/2000 Conrad et al. ..... 15/353
6,146,434 A * 11/2000 Scalfani et al. ..... 15/353
6,245,159 B1 * 6/2001 Deng ..... 15/346
6,345,411 B1 * 2/2002 Kato et al. ..... 15/346

* cited by examiner

*Primary Examiner*—Theresa T. Snider
(74) *Attorney, Agent, or Firm*—McDermott, Will & Emery

(57) ABSTRACT

A vacuum cleaner includes an electric blower generating the suction force; a suction port body on which the suction force of the electric blower acts and which sucks in the dust on the surface to be cleaned; and a centrifugal force dust collection section to collect the dust from the suction port body. The electric blower includes a fan section and a low input type motor to drive the fan section.

43 Claims, 10 Drawing Sheets

VACUUM CLEANER USING CENTRIFUGAL FORCE DUST COLLECTION TO PREVENT FILTER BLINDING

BACKGROUND OF THE INVENTION

1. Field of the Invention

The present invention relates to a vacuum cleaner provided with a centrifugal force dust collection section which collects the dust by the centrifugal force by the cyclone action.

2. Description of the Related Art

Conventionally, this kind of centrifugal force dust collection section is structured as shown in FIG. 12 and FIG. 13. The structure will be described below.

As shown in the drawings, a dust collecting container 1 is formed cylindrically, and a suction air port 2 is provided on the lower side wall, and a guide plate 3 is provided on the inner wall of the suction air port 2. A cover body 4 is attached to the upper end opening of the dust collecting container 1 so that it can be opened and closed and is air tight, and a suction and exhaust air apparatus 5 is attached to the inner surface of the cover body 4.

The suction and exhaust air apparatus 5 is structured by a fan (not shown) and a motor (not shown) to drive the fan, and exhausts the air introduced from the suction air port 2 into the dust collecting container 1, from the exhaust air port 4*a* provided on the side surface of the cover body 4 and the exhaust air port 4*b* provided on the upper surface of the cover body 4.

A filter supporting body 6 is attached such that it surrounds the suction and exhaust air apparatus 5 on the inner surface of the cover body 4, and a large number of vent holes 6*a* are provided on its wall surface. An almost conical paper filter 7 is attached to the outer surface of the filter supporting body 6 such that the filter 7 surrounds the filter supporting body 6. A holder piece 8 holds the tip of the paper filter 7.

In the above structure, when a suction hose (not shown) is connected to the suction air port 2 of the dust collection container 1, and the suction and exhaust air apparatus 5 is operated, the direction of the air introduced from the suction air port 2 is changed, and as shown by an arrow, it becomes the eddy current along the inner periphery of the dust collection container 1, and rotates around the periphery of the paper filter 7, and by its centrifugal force by the cyclone action, the dust in the air is collected along the inner wall surface of the dust collection container 1, and the large dust is collected on the base portion of the dust collection container 1, and only the greatly fine dust adheres onto the paper filter 7.

In the above conventional structure, because the suction air port 2 is provided in the lower portion of the dust collection container 1, the air including the dust introduced from the suction air port 2 rotates along the inner peripheral surface of the dust collection container 1, and the dust is collected by the centrifugal force by the cyclone action, however, because the collected dust is accumulated on the lower portion of the dust collection container 1, the air from the suction air port 2 blows up the collected dust, and the dust adheres onto the overall filter 7, therefore, there is a problem that blinding is accelerated. Accordingly, it is structured in such a manner that the paper filter can be easily attached and replaced.

Further, it is not entirely considered that the blinding of the paper filter 7 is made minimum so that the draft resistance due to the blinding of the filter is reduced, and as the suction and exhaust air apparatus 5, it is the mandatory requirement to use the high input type motor so that the dust collection can be conducted even in the condition that the paper filter 7 is blinded. Therefore, there is also a problem that the size of the apparatus becomes large.

SUMMARY OF THE INVENTION

The present invention has been made to solve the conventional problems, and therefore an object of the present invention is to obtain a vacuum cleaner which is small in size and light in weight, and which can be operated by the low power consumption.

In order to attain the above object, the present invention is structured in such a manner that the dust on the surface to be cleaned is sucked by the suction port body on which the suction force of the electric blower generating the suction force is acted, and the dust from the suction port body is collected in the centrifugal force dust collection section, and the electric blower is composed of the fan section and the motor to drive the fan section, and the motor is a low input type motor.

According to the invention, by driving the fan section by the low input type motor, the flowing speed in the small-sized centrifugal force dust collection section can be made optimum, and while keeping the dust collection performance by the centrifugal force dust collection, the centrifugal force dust collection section is made small and light weight, and the vacuum cleaner of the low power consumption can be obtained.

According to a first aspect of the present invention, there is provided a vacuum cleaner, comprising: an electric blower which generates the suction force; a suction port body on which the suction force of the electric blower acts and which sucks the dust on the surface to be cleaned; and the centrifugal force dust collection section which collects the dust from the suction port body, wherein the electric blower is structured by a fan section and a motor to drive the fan section, and the motor is a low input type motor, and the air including the dust on the surface to be cleaned sucked from the suction port body by the suction force of the electric blower, flows into the centrifugal force dust collection section, and centrifugal force-dust-collected by the cyclone action. Herein, by driving the fan section by the low input type motor, the flowing speed in the small-sized centrifugal force dust collection section can be made optimum, and while keeping the dust collection performance by the centrifugal force dust collection, the centrifugal force dust collection section is made small and light weight, and the vacuum cleaner of the low power consumption can be obtained. Further, when the motor is a low input type motor, the motor can be operated by the battery, and can be made cordless, thereby, the cleaning operability can be increased.

According to a second aspect of the present invention, there is provided a vacuum cleaner, comprising: an electric blower to generate the suction force; a suction port body on which the suction force of the electric blower acts, and which sucks the dust on the surface to be cleaned; the centrifugal force dust collection section to collect the dust from the suction port body; and an exhaust air path to guide the exhaust air of the electric blower to the suction port body, wherein the electric blower is structured by a fan section and a motor to drive the fan section, and the motor is a low input type motor, and the air including the dust on the surface to be cleaned sucked from the suction port body by the suction force of the electric blower, flows into the centrifugal force dust collection section, and centrifugal force-dust-collected by the cyclone action. Herein, by driving the fan section by the low input type motor, the flowing speed in the small-sized centrifugal force dust collection section can be made optimum, and while keeping the dust collection performance in the centrifugal force dust collection, the vacuum cleaner of the low power consumption can be obtained, and by guiding the exhaust air of the electric blower to the suction port body through the exhaust air path, the dust on the surface to be cleaned can be blown up by the exhaust air of the electric blower, thereby, the dust collection performance can be more increased. Further, when the motor is a low input type motor, the motor can also be operated by the battery. Further, when the motor is a low input type motor, the heat generation of the motor can be suppressed lower, and specifically, in the exhaust air circulation type vacuum cleaner in which the exhaust air of the electric blower is sent to the suction port body, and the exhaust air blown off from the suction port body is sucked again by the electric blower, although the temperature of the exhaust air rises, however, by using the low input type motor, the temperature rise of the exhaust air can be suppressed.

According to a third aspect of the present invention, in the invention of the first or second aspect of the present invention, because the motor is a low input type motor of not larger than 300 W, the flowing speed in the centrifugal force dust collection section can be made optimum, thereby, while keeping the dust collection performance in the centrifugal force dust collection, the vacuum cleaner of the low power consumption can be obtained. Further, when the motor is a low input type motor of not larger than 300 W, the heat generation of the motor can be suppressed to low, and even when the motor is driven by the battery, in this input, the vacuum cleaner is appropriate for the practical use for its weight and size.

According to a forth aspect of the present invention, in the second aspect of the present invention, because the motor is a low input type motor of not larger than 200 W, even in the exhaust air circulation type vacuum cleaner in which the exhaust air of the electric blower is sent to the suction port body, and the exhaust air blown off from the suction port body is sucked again by the electric blower, the temperature rise of the exhaust air can be suppressed. Specifically, in the vacuum cleaner of the type in which all of the exhaust air of the electric blower is circulated, that is, the exhaust air is not exhausted to the outside of the main body, it is experimentally confirmed that the upper limit, in which the deterioration of the electric blower due to the temperature rise of the exhaust air can be prevented, is a low input type motor of 200 W.

According to a fifth aspect of the present invention, in the first to fourth aspects of the present invention, there is further provided with a filter to remove the dust flowing into the electric blower from the centrifugal force dust collection section, and when the air including the dust sucked from the suction port body, flows into the centrifugal force dust collection section and centrifugal force-dust-collected by the cyclone action, the large dust is accumulated on the bottom portion of the centrifugal force dust collection section, and the small dust adheres to the filter. Thereby, the draft pressure loss of the filter can be made small for a long period of time, and the high dust collection performance can be obtained also by the electric blower composed of the low input type motor.

According to a sixth aspect of the present invention, in the first to fifth aspects of the present invention, the motor is a DC motor, and when the DC motor is used as a motor, because the copper loss is small, and the energy conversion rate is high, the low power consumption and low input type motor can be attained, and the size can be reduced, and further, in the case of the circulation type in which the exhaust air of the electric blower is guided to the suction port body through the exhaust air path, the motor can be cooled by a portion of the exhaust air, and the size can be more reduced.

According to a seventh aspect of the present invention, in the first to sixth aspects of the present invention, the motor is driven by a battery, and when the cleaning is conducted, the suction port body can be freely moved to the surface to be cleaned as the cordless cleaner, thereby, the operability can be increased, and just a little amount of cleaning can also conduct easily and simply, and because the motor is low power consumption and low input type motor, even when it is driven by the battery, the cleaning can be conducted for a long period of time.

According to the eighth aspect of the present invention, in the seventh aspect of the present invention, the battery can be charged, therefore, when the cleaning is conducted, the suction port body can be freely moved to the surface to be cleaned as the cordless cleaner, thereby, the operability can be increased, and just a little amount of cleaning can also conduct easily and simply, and because the motor is low power consumption and low input type motor, even when it is driven by the battery, the cleaning can be conducted for a long period of time, and further, when no cleaning is conducted, the battery is charged, therefore, even in the next cleaning, the cleaning operation time, that is, the driving continuance time of the electric blower can be secured.

According to a ninth aspect of the present invention, in the first to eighth aspects of the present invention, the suction air port to introduce the dust from the suction port body, and the exhaust air port to communicate with the suction side of the electric blower are provided in the centrifugal force dust collection section, and the filter is provided so as to cover the exhaust air port, and the air including the dust introduced from the suction air port into the centrifugal force dust collection section, is exhausted from the exhaust air port, after the dust is collected by the centrifugal force by the cyclone action in the centrifugal force dust collection section. At this time, the large dust is accumulated on the bottom portion of the centrifugal force dust collection section, and the small dust adheres to the filter provided so as to cover the exhaust air port, therefore, the draft pressure loss of the filter can be made small for a long period of time, and the high dust collection performance can be obtained.

According to a tenth aspect of the present invention, in the ninth aspect of the present invention, the suction air port is provided on the side of the centrifugal force dust collection section, and the exhaust air port is provided above the centrifugal force dust collection section, therefore, the air including the dust introduced from the suction air port into the centrifugal force dust collection section, generates the eddy current in the centrifugal force dust collection section and is moved to the lower side, and the eddy current moved to the lower side rises from its central portion toward the upper side exhaust air port, that is, the cyclone action is generated. At this time, the large dust is accumulated on the bottom portion of the centrifugal force dust collection section, and the small dust adheres to the filter provided so as to cover the exhaust air port, therefore, the draft pressure loss of the filter can be made small for a long period of time, and the high dust collection performance can be obtained.

According to an eleventh aspect of the present invention, in the ninth or tenth aspect of the present invention, the lower portion of the filter is positioned above the suction air port, and by the suction force of the electric blower, when the air including the dust introduced from the suction air port into the centrifugal force dust collection section, is formed into the eddy current along the inner periphery of the centrifugal force dust collection section, and rotated, the dust does not directly touch the filter, and the dust can be smoothly collected by the centrifugal force due to the cyclone action, thereby, the dust collection performance can be increased.

According to a twelfth aspect of the present invention, in the ninth or tenth aspect of the present invention, the lower end portion of the filter is positioned below the suction air port, and when the air including the dust introduced from the suction air port into the centrifugal force dust collection section by the suction force of the electric blower, is formed into the eddy current along the inner periphery of the centrifugal force dust collection section, and rotated, the dust directly touches the side surface of the filter in the vicinity of the suction air port, therefore, the filter can be cleaned thereby, and the dust collection performance can be increased.

According to a thirteenth aspect of the present invention, in the ninth or tenth aspect of the present invention, the lower portion of the filter overlaps with one portion of the suction air port, and when the air including the dust introduced from the suction air port into the centrifugal force dust collection section by the suction force of the electric blower, is formed into the eddy current along the inner periphery of the centrifugal force dust collection section and rotated, the dust directly touches the side surface and the bottom surface of the filter in the vicinity of the suction air port, therefore, the filter can be cleaned thereby extending to the wide range, and the dust collection performance can be increased.

According to a fourteenth aspect of the present invention, in the first to eighth aspects of the present invention, the centrifugal force dust collection section is composed of the dust box with the bottom provided with the suction air port, and the cover body to cover the upper opening portion of the dust box and provided with the exhaust air port, and the upper opening portion is covered by the filter, and the dust from the suction port body is introduced from the suction air port into the dust box constituting the centrifugal force dust collection section, by the suction force of the electric blower, and the introduced the air including the dust is formed into the eddy current along the inner periphery of the dust box and rotated, and the dust is collected by the centrifugal force due to the cyclone action, and the large dust is accumulated on the bottom portion of the dust box, and the small dust adheres to the filter to cover the upper opening portion, therefore, the high dust collection performance can be obtained for a long period of time. Further, the content volume of the dust box is an amount in which large dust can be accumulated, and when the dust box is filled with the dust, only the dust box is taken off, and the dust can be abandoned. In this case, because the upper opening portion of the dust box is covered by the filter, that is sanitary.

According to a fifteenth aspect of the present invention, in the first to eighth aspects of the present invention, the centrifugal force dust collection section is composed of the dust box with the bottom provided with the suction air port, and the cover body to cover the upper opening portion of the dust box, and the cover body is provided with the exhaust air port, and the filter is provided on the cover body so as to cover the exhaust air port, and the dust from the suction port body is introduced from the suction air port into the dust box constituting the centrifugal force dust collection section, by the suction force of the electric blower, and the introduced the air including the dust is formed into the eddy current along the inner periphery of the dust box and rotated, and the dust is collected by the centrifugal force due to the cyclone action, and the large dust is accumulated on the bottom portion of the dust box, and the small dust adheres to the filter to cover the upper opening portion, therefore, the high dust collection performance can be obtained for a long period of time. Further, because the filter is provided on the cover body so as to cover the exhaust air port, the filter does not protrude into the dust box, therefore, the content volume of the dust box can be increased, the amount of the dust which can be accumulated, can be increased.

According to a sixteenth aspect of the present invention, in the first to eighth aspects of the present invention, the centrifugal force dust collection section is composed of the dust box with the bottom, and the cover body to cover the upper opening portion of the dust box, and the cover body is provided with the suction air port and the exhaust air port, and the filter is provided on the cover body so as to cover the exhaust air port, and the dust from the suction port body is introduced from the suction air port into the dust box constituting the centrifugal force dust collection section, by the suction force of the electric blower, and the introduced the air including the dust is formed into the eddy current along the inner periphery of the dust box and rotated, and the dust is collected by the centrifugal force due to the cyclone action, and the large dust is accumulated on the bottom portion of the dust box, and the small dust adheres to the filter to cover the upper opening portion, therefore, the high dust collection performance can be obtained for a long period of time. Further, when the dust box is filled with the dust, only the dust box is taken off, and the dust can be abandoned. In this case, because the suction air port and the exhaust air port are provided on the cover body, the opening portion such as the suction air port, or the exhaust air port is not necessary in the dust box. Accordingly, the dust can be accumulated to the upper opening portion, and when the dust is abandoned, because the dust box has no opening portion, the dust does not spill over.

According to a seventeenth aspect of the present invention, in the ninth to fifteenth aspects of the present invention, the surface area of the filter is not smaller than the area of the exhaust air port, and the draft pressure loss can be made small for a long period of time, and the high dust collection performance can be obtained.

According to an eighteenth aspect of the present invention, in the first to seventeenth aspects of the present invention, since the rotating brush which is driven by the motor or the air turbine is disposed on the suction port body, the dusts can be mechanically scrapped up. As a result, the performance of collecting the dust on a carpet can be enhanced even by a low-input type electric blower, thereby being capable of downsizing the fan motor and the centrifugal force dust collection section.

DETAILED DESCRIPTION OF THE PREFERRED EMBODIMENTS

Figure 1:
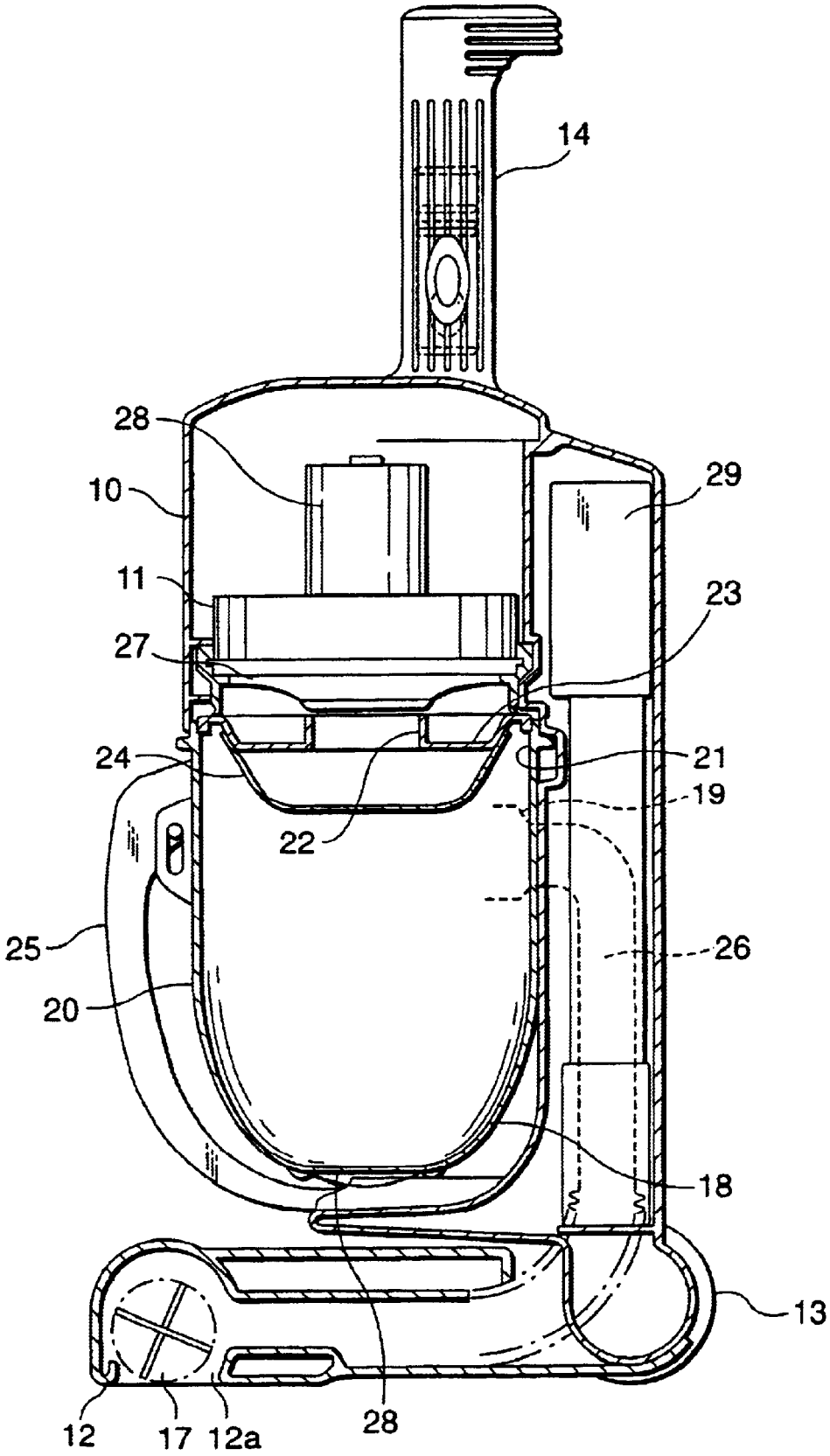
FIG. 1 is a longitudinal sectional view showing a vacuum cleaner according to a first embodiment of the present invention.

Referring to the drawings, the embodiments of the present invention will be described below.

(The First Embodiment)

Figure 2:
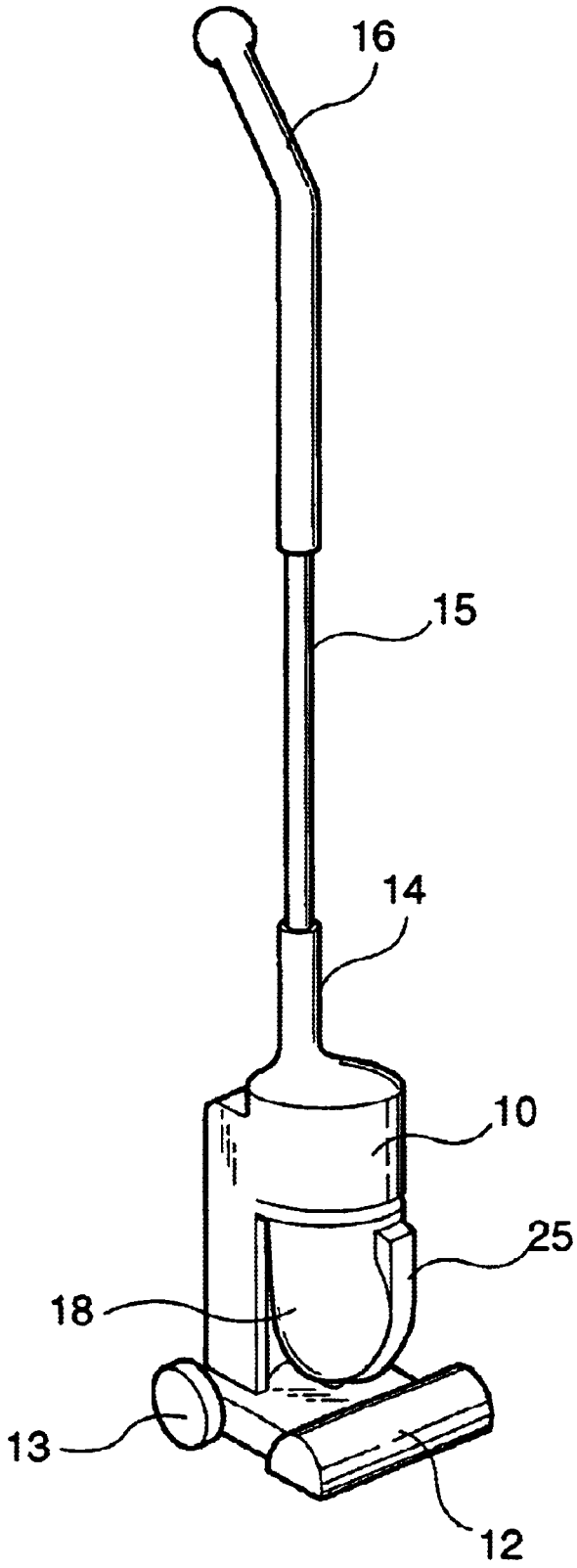
FIG. 2 is a perspective view showing a vacuum cleaner according to the first embodiment of the present invention.
Figure 3:
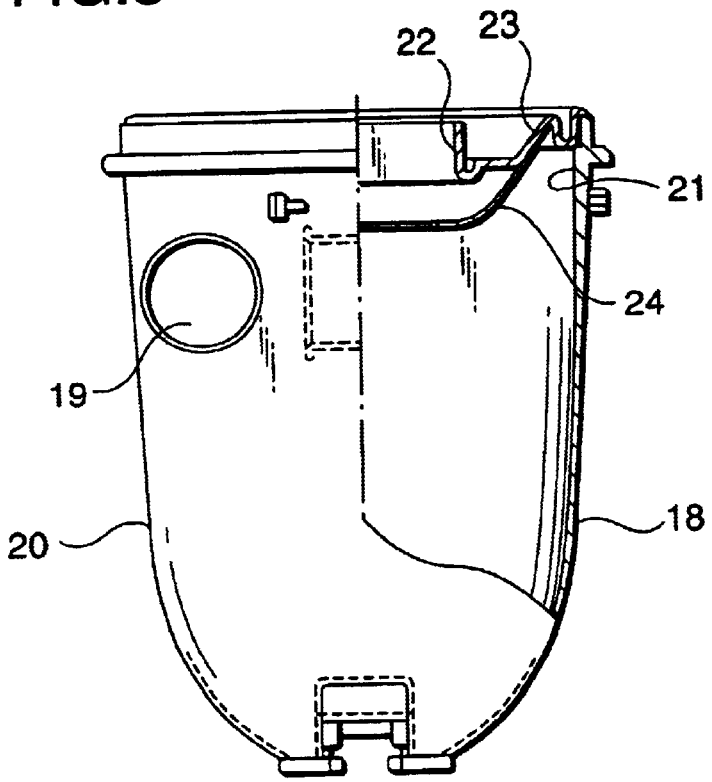
FIG. 3 is a partially cutout front view showing a centrifugal force dust collection section of the vacuum cleaner according to the first embodiment of the present invention.

Referring to FIGS. 1 to 3, the first embodiment of the present invention will be described below.

A cleaner main body 10 houses an electric blower 11 generating the suction force therein, and a suction port body 12 is provided in the front lower portion, and a roller 13 is provided in the rear lower portion, and the cleaner main body 10 can move on the surface to be cleaned by operating a handle portion 14 provided in its upper portion. Further, by attaching a grip 16 to the handle portion 14 through an extension tube 15, the cleaner main body can be operated at the height of operator's hand.

A rotating brush 17 which is driven by a motor or an air turbine (not shown) and scrapes up the dust on the surface to be cleaned is provided in the suction port body 12, and is structured such that the dust on the surface to be cleaned is sucked in the suction port body 12 by the action of the suction force of the electric blower 11.

A centrifugal force dust collection section 18 collects the dust from the suction port body 12, and is structured by, as shown in FIG. 3, an almost cylindrically formed dust box 20 with a bottom, which is provided with a suction air port 19 in the tangential direction on the side wall, and a cover body 23 which covers an upper opening portion 21 of the dust box 20, and is provided with an exhaust air port 22, and the upper opening portion 21 is covered by a filter 24. Herein, the lower portion of the filter 24 is positioned above the suction air port 19. Further, the surface area of the filter 24 is larger than the area of the exhaust air port 22.

The centrifugal force dust collection section 18 has a knob 25, and by this knob 25, the centrifugal force dust collection section 18 can be detachably attached to the cleaner main body 10, and the centrifugal force dust collection section 18 is structured such that, when it is attached to the cleaner main body 10, the suction air port 19 is brought into pressure contact with a suction air path 26 communicating with the suction port body 12, and these are air-tightly connected.

The electric blower is composed of a fan section 27 and a motor 28 to drive the fan section 27, and the motor 28 is structured by a DC motor, and a low input type motor of the motor input 40 W and fan output 20 W, is used. A battery 29 drives the motor 28, and 10 cells of a chargeable nickel-cadmium battery(1.2 V/cell) are used, and 12 V is applied on the motor 28, and the current of 3.3 A is circulated. By this battery 29, the 25 minutes continuous operation can be carried out.

In the above structure, the operation will be described. When the centrifugal force dust collection section 18 is attached to the cleaner main body 10 and the operation is started, the suction force of the electric blower 11 acts on a path, from the suction port body 12, through a suction air path 26, the suction air port 19 of the centrifugal force dust collection section 18, the filter 24 and the exhaust air port 22 of the centrifugal force dust collection section 18, and by the suction force of the electric blower 11, the dust on the surface to be cleaned scraped up by a rotating brush 17 is sucked-in from the suction port body 12. This sucked dust is introduced into the centrifugal force dust collection section 18 from the tangential direction from the suction air port 19 through the suction air path 26 communicating with the suction port body 12 together with the air.

When the cylindrical dust box 20 with the bottom is viewed from the above, the side wall is a circle, and the suction air port 19 is provided so that the air including the dust is introduced into the port 19 in the tangential direction with the circle. The air including the dust introduced from the suction air port 19 in the tangential direction is formed into the eddy current along the inner peripheral surface of the centrifugal force dust collection section 18 by the cyclone action and moves downward while rotating, and when it is lowered to near the lower end, the flow is turned to start the rising, and rises toward the exhaust air port 22 while rotating at the central portion of the centrifugal force dust collection section 18.

At this time, by the centrifugal force due to the cyclone action, the dust in the air is lowered along the inner wall surface of the dust box 20 constituting the centrifugal force dust collection section 18, and the large dust is accumulated on the bottom portion of the dust box 20, and the fine dust is turned to rise at the almost central portion of the dust box 20 and is caught by the filter 24.

That is, by collecting the dust by the centrifugal force due to the cyclone action, the dust which is going to flow into the suction side of the electric blower 11, can be reduced, and accordingly, an amount of the dust adhered to the filter 24 to remove the dust is greatly reduced. Specifically, as a position is apart from the bottom surface of the dust box 20, the influence due to soaring of the dust is reduced, and the adherence of the dust by the soaring at the near position of the exhaust air port 22 can also be suppressed to be small.

As described above, by providing the filter 24 at the position separated from the bottom surface of the dust box 20, every time when the dust accumulated in the dust box 20 is removed, the blinding of the filter 24 is not so severe that the cleaning of the filter is necessary, and the high dust collection performance can be obtained for a long period of time, and the operability can be increased.

Further, when the low input type motor 28 is adopted, the speed of the air flow which flows from the bottom portion of the centrifugal force dust collection section 18 toward the exhaust port 22, also becomes slow, and the effect to suppress the soaring of the dust can also be obtained. As described above, by the combination of the low input type motor 28 with the centrifugal force dust collection section 18, because all of the dust is not removed by only the filter 24, the filter is hardly blinded, and it is also prevented that the draft resistance of the filter 24 becomes too large for the low input type motor 28, thereby, it is very advantageous for the adoption of the low input type motor 28.

Further, the content volume of the dust box 20 is an amount in which large dust can be accumulated, and in the case where the dust box is filled with the dust, when the dust box 20 is taken off and the dust is abandoned, because the upper opening portion 21 of the dust box 20 is covered by the filter 24, the fine dust does not scatter, which is sanitary.

Further, because the lower portion of the filter 24 is positioned above the suction air port 19, by the suction force of the electric blower 11, when the dust introduced from the suction air port 19 into the dust box 20 in the tangential direction, is formed into the eddy current along the inner peripheral surface of the dust box 20, and rotated, the dust does not directly touch the filter 24, and the dust can be smoothly collected by the centrifugal force due to the cyclone action, thereby, the dust collection performance can be increased.

Further, because the surface area of the filter 24 is not smaller than the area of the exhaust air port 22, the draft pressure loss of the filter 24 can be made small for a long period of time. Accordingly, a high dust collection performance can be obtained while minimizing the required suction force.

Herein, when the motor 28 constituting the electric blower 11 is the low input type motor, the motor 28 itself can be relatively small, and when the motor 28 is driven by the battery 29, the battery 29 can be of relatively small size and light weight, and the weight of the cleaner itself can be minimized.

That is, when the motor 28 is driven by using the battery 29 and cleaning is conducted, it is important that the input of the motor 28 is suppressed to be low, and the voltage and the current of the battery 29 are reduced. When, in the battery 29, the current exceeding 10 A flows, heat generation occurs, and the battery performance is lowered, and further, when the voltage of the battery 29 is raised, it is necessary that the number of cells of the battery 29 is increased.

For example, in a vacuum cleaner to which the electric power is supplied by a commercial power, more than 1000 W is supplied to the cleaner, however, when this input power is realized by the nickel-cadmium battery, initially, the current limit of 10 A exists, and when the voltage is considered on the base of this 10 A, the voltage of 100 V is necessary.

When this 100 V is generated by the nickel-cadmium battery, about 83 cells are necessary, and when the battery weight (150 g×83=4150 g) and the battery accommodation space, and the like, are considered, it can not possibly be adopted for the cleaner. Further, even when a led battery (2 V) whose voltage per 1 cell is high is used, 50 cells (125 g×50=6250 g) are necessary, and it is difficult to be adopted for the cleaner, as described above.

Accordingly, when the motor input for which even a battery 29 can be used, is considered, in the present state, the motor input is not more than 300 W, that is, when the current is 10 A, the voltage is 30 V, and when the nickel-cadmium battery is used, 25 cells (1250 g) are necessary, and this is within a range in which it can be put to the practical use. On the one hand, when cleaning operability, and the portability are considered, it is preferable that the weight of the cleaner main body is suppressed to be not more than 4 kg, and because, to this total weight, in addition to the weight of the battery, the weight of the external frame of the main body, the weight of the motor, the soundproof member, parts of the control circuit, etc., are added, when the weight of the battery is not smaller than 2 kg, it is difficult to suppress the weight of the cleaner main body to be not more than 4 kg.

Further, because the motor 28 comprises a DC motor, by using the DC motor, the copper loss is small, and the energy conversion rate can be increased, therefore, the low power consumption and the low input type motor can be attained, and the size can be reduced.

Further, by driving the motor 28 by a battery 29, when cleaning is conducted, the suction port body 12 can be freely moved to the surface to be cleaned without the need for power cords, thereby, the operability can be increased, and just a little amount of cleaning can also be conducted easily and simply, and because the motor 28 is low power consumption and low input type motor, even when it is driven by the battery 29, the cleaning can be conducted for a long period of time.

Further, in the case where the chargeable nickel-cadmium battery is used, when no cleaning is conducted, the battery can be charged, therefore, when it is used for the next cleaning, the battery is fully charged, and the cleaning operation time can be secured.

Figure 4:
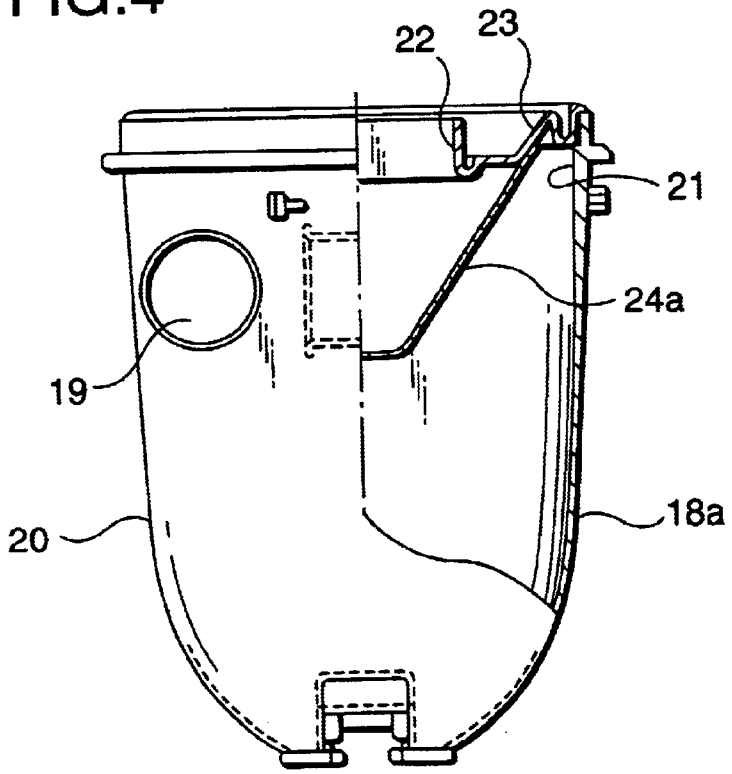
FIG. 4 is a partially cutout front view showing a centrifugal force dust collection section of the vacuum cleaner according to another example.

Incidentally, in the above embodiment, the lower portion of the filter 24 is positioned above the suction air port 19, however, as shown in FIG. 4, the lower end portion of the filter 24*a* may be positioned below the suction air port 19, and in this case, when the air including the dust introduced from the suction air port 19 (which suction air port 19 is provided on the dust box 20 constituting the centrifugal force dust collection section 18*a*) into the dust box 20 in the tangential direction by the suction force of the electric blower 11, is formed into the eddy current along the inner periphery of the dust box 20, and rotated, the dust directly touches the side surface of the filter 24*a* in the vicinity of the suction air port 19, therefore, the filter 24*a* can be cleaned by itself, and the dust collection performance can be increased.

Figure 5:
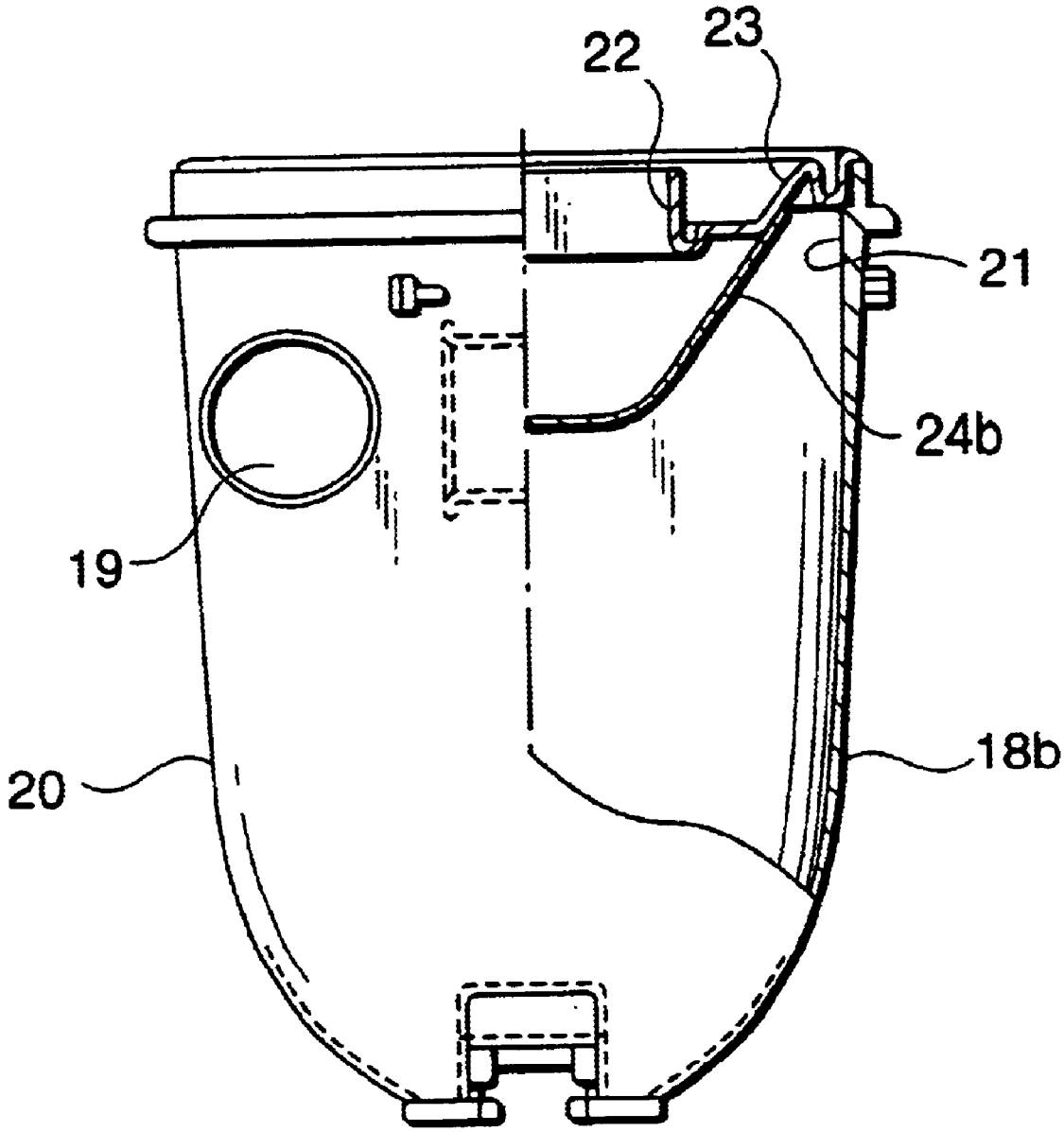
FIG. 5 is a partially cutout front view showing a centrifugal force dust collection section of the vacuum cleaner according to another example.

Further, as shown in FIG. 5, the lower portion of the filter 24*b* may overlap with a portion of the suction air port 19, and in this case, when the air including the dust introduced from the suction air port 19 provided on the dust box 20 constituting the centrifugal force dust collection section 18*b* into the dust box 20 in the tangential direction by the suction force of the electric blower 11, is formed into the eddy current along the inner periphery of the dust box 20, and rotated, the dust directly touches the side surface and the bottom surface of the filter 24*b* in the vicinity of the suction air port 19, therefore, the filter 24*b* can be self-cleaned over a wide range of its surface, and the dust collection performance can be increased.

(The Second Embodiment)

Figure 6:
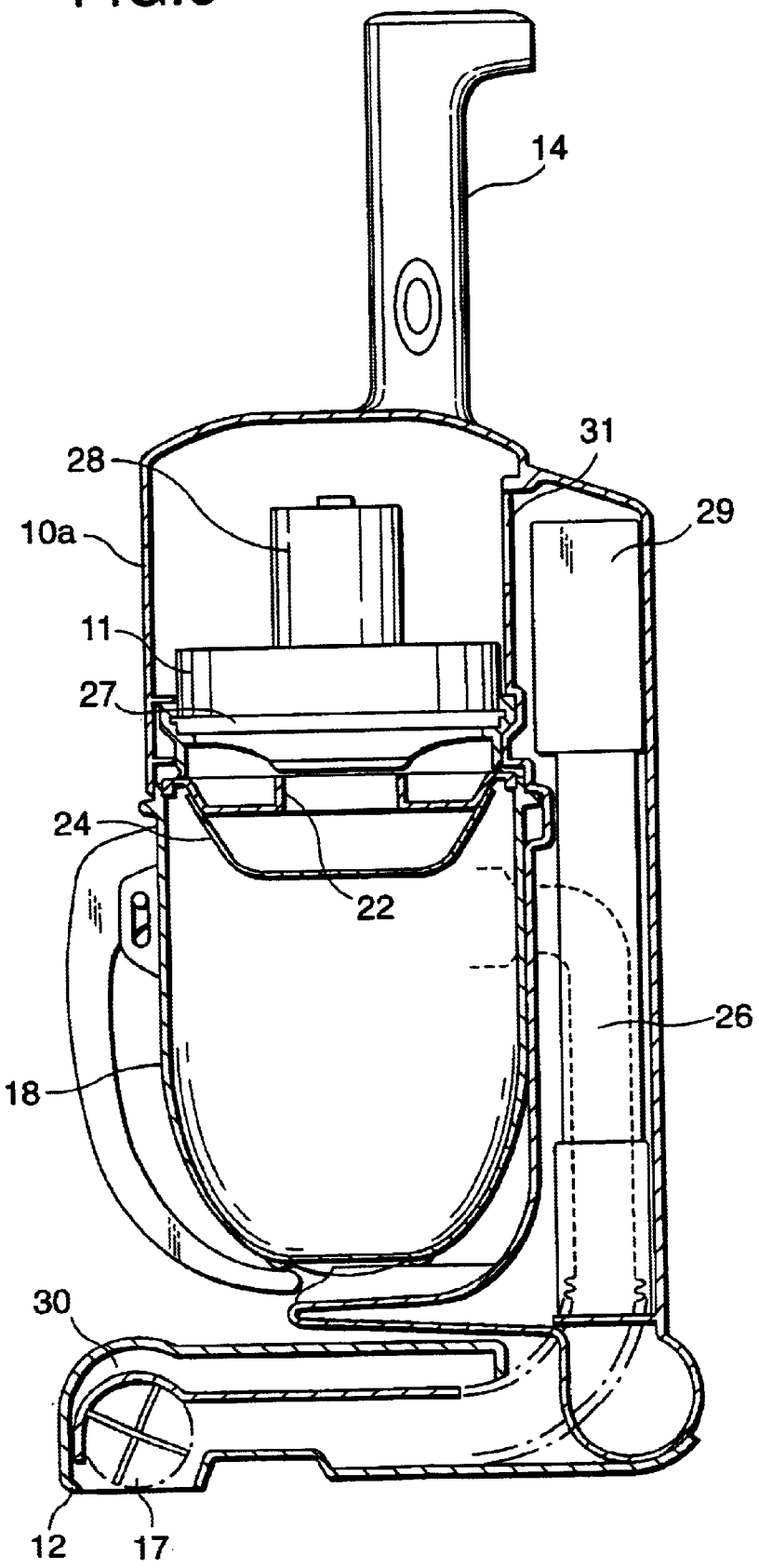
FIG. 6 is a longitudinal sectional view showing a vacuum cleaner according to the second embodiment of the present invention.
Figure 7:
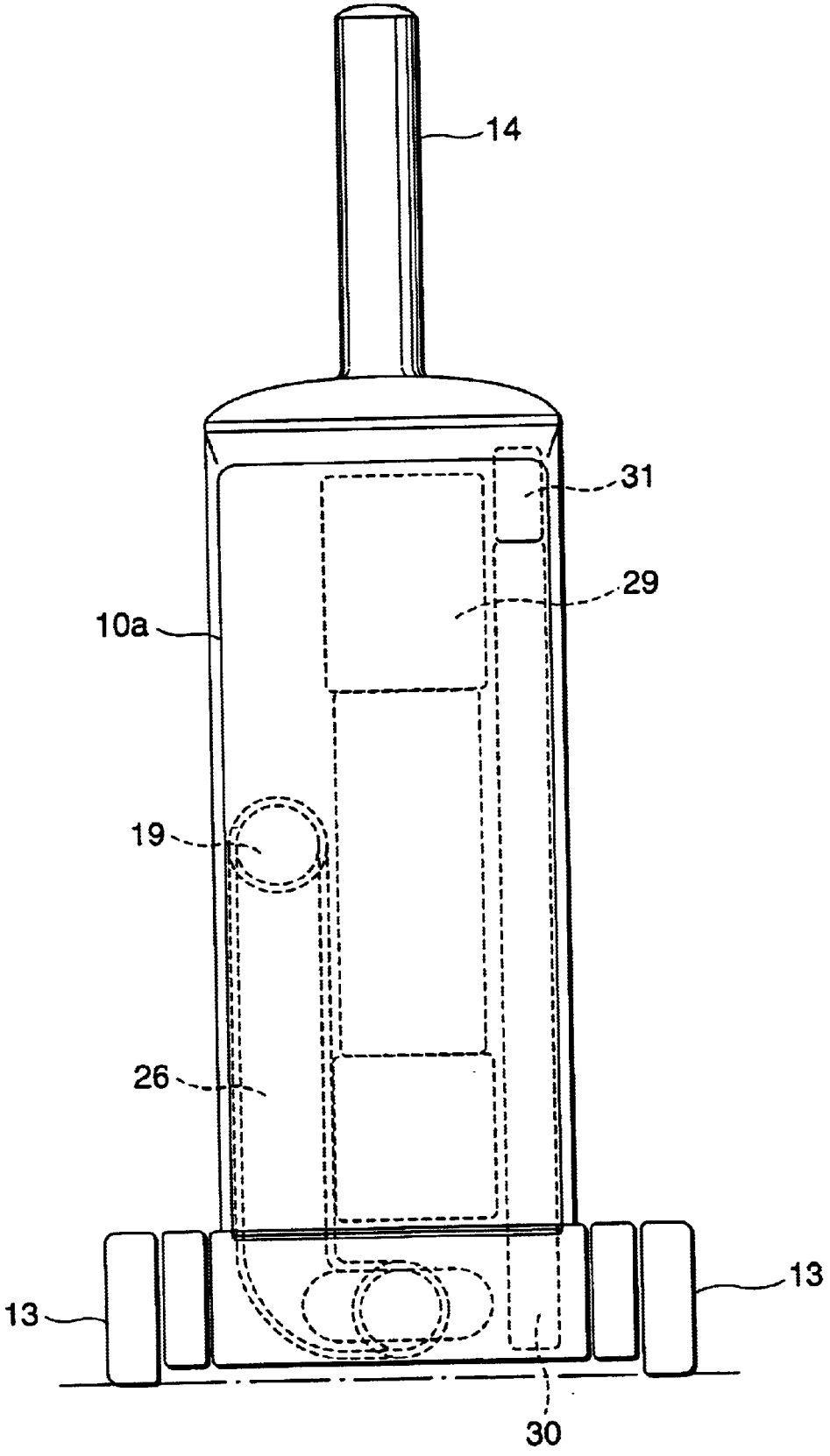
FIG. 7 is a front view showing a vacuum cleaner according to the second embodiment of the present invention.
Figure 8:
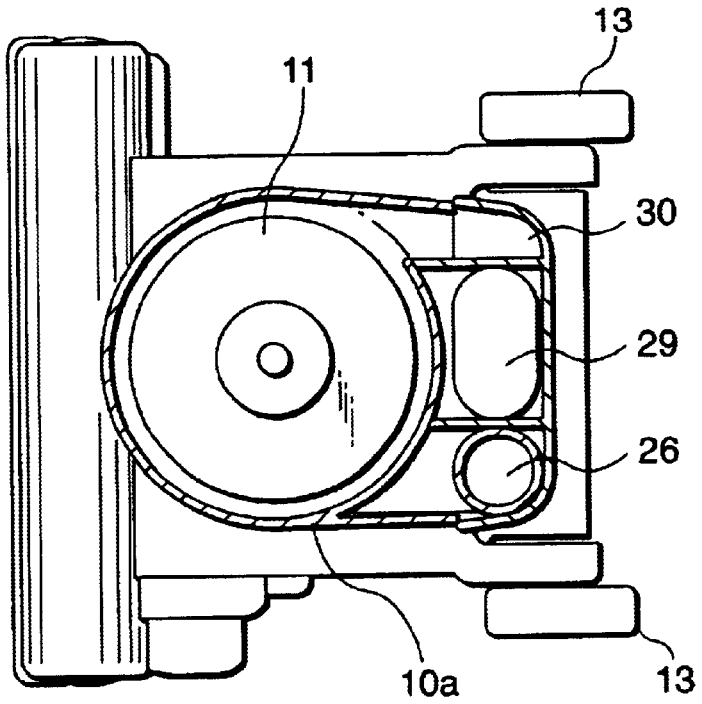
FIG. 8 is a transverse sectional view showing a vacuum cleaner according to the second embodiment of the present invention.

Referring to FIGS. 6 to 8, the second embodiment of the present invention will be described below. Incidentally, the same parts as those in the above embodiment, are denoted by the same numeral code, and their explanation will be omitted.

A cleaner main body 10*a* is structured such that it houses therein the electric blower 11 generating the suction force, and the suction port body 12 is provided in the front lower portion, and the centrifugal force dust collection section 18 can be detachably attached, and when it is attached to the cleaner main body 10*a*, the suction air port 19 is brought into pressure-contact with the suction air path 26 communicating with the suction port body 12 and can be air tightly connected. An exhaust air path 30 guides a part or the whole of the exhaust air of the electric blower 11 to the suction port body 12 through the exhaust air hole 31. Other structures are the same as in the above embodiment 1.

In the above structure, operations will be described below. When the centrifugal force dust collection section 18 is attached to the cleaner main body 10*a* and the operation is started, in the same manner as in the above embodiment 1, the suction force of the electric blower 11 acts on a path, from the suction port body 12, through a suction air path 26, the suction air port 19 of the centrifugal force dust collection section 18, the filter 24 and the exhaust air port 22 of the centrifugal force dust collection section 18, and by the suction force of the electric blower 11, the dust on the surface to be cleaned scraped up by the rotating brush 17 is sucked-in from the suction port body 12. This sucked dust is introduced into the centrifugal force dust collection section 18 in the tangential direction from the suction air port 19 through the suction air path 26 communicating with the suction port body 12 together with the air.

The air including the dust introduced from the suction air port 19 in the tangential direction is formed into the eddy current along the inner peripheral surface of the centrifugal force dust collection section 18 and moves downward while rotating, and when it is lowered to near the lower end, the flow is turned to start the rising, and rises toward the exhaust air port 22 while rotating at the central portion of the centrifugal force dust collection section 18.

At this time, by the centrifugal force due to the cyclone action, the dust in the air is lowered along the inner wall surface of the dust box 20 constituting the centrifugal force dust collection section 18, and the large dust is accumulated on the bottom portion of the dust box 20, and the fine dust is turned to rise at the almost central portion of the dust box 20 and is adhered to the filter 24.

At this time, a portion of the exhaust air of the electric blower 11 is introduced into the suction port body 12 through the exhaust air path 30, and by blowing out the exhaust air from a blow out port provided in the front of the rotating brush 17, the dust on the surface to be cleaned can be lifted by the exhaust air of the electric blower 11, thereby, the dust collection performance can be improved.

Incidentally, in the present embodiment, the exhaust air re-circulation system by which a portion of the exhaust air of the electric blower 11 is blown out into the suction port body 12, and the blown out exhaust air is returned again to the electric blower 11, is adopted, and because the electric blower adopts the structure to cool the motor 28 by the sucked air, when the input of the motor 28 is 300 W and the whole exhaust air is circulated, the temperature of the motor 28 may become too high. That is, because air sucked by the motor 28 is warmed, by circulating a portion of the exhaust air, for the remaining portion, the cool outside air can be sent to the electric blower 11 side, thereby, the temperature rise of the motor 28 can be suppressed. On the one hand, it is experimentally confirmed that, when whole exhaust air is circulated, by suppressing the input of the motor 28 to a value not larger than 200 W, the abnormal temperature rise of the motor 28 can be prevented.

(The Third Embodiment)

Figure 9:
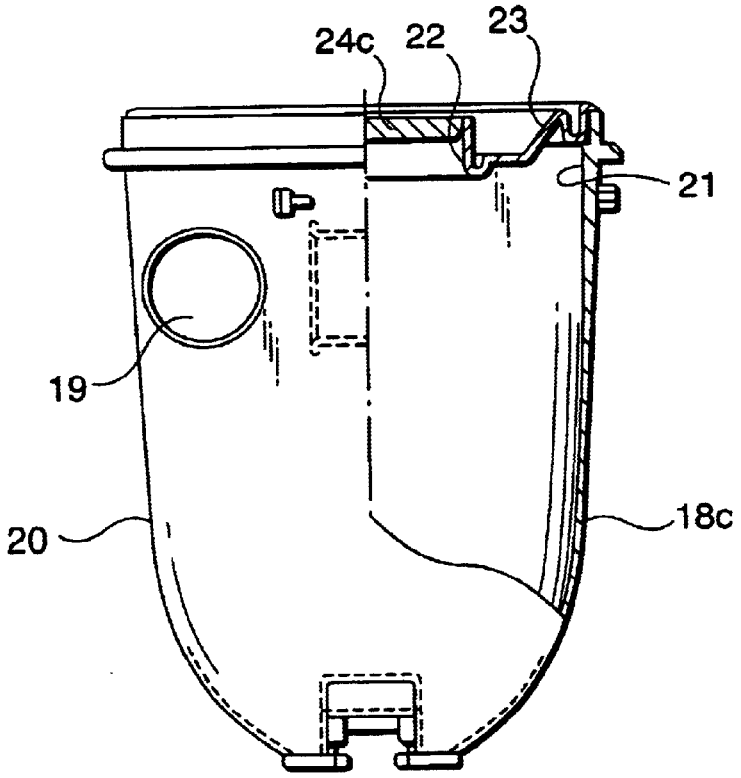
FIG. 9 is a partially cutout front view showing a centrifugal force dust collection section of a vacuum cleaner according to a third embodiment of the present invention.

Referring to FIG. 9, the third embodiment of the present invention will be described below. Incidentally, the same parts as those in the above embodiment, are denoted by the same numeral code, and their explanation will be omitted.

The centrifugal force dust collection section 18 is composed of the dust box 20 with the bottom provided with the suction air port 19, and the cover body 23 to cover the upper opening portion 21 of the dust box 20, and the exhaust air port 22 is provided in the cover body 23, and a filter 24*c* is provided on the cover body 23 to cover the exhaust air port 22. The other structure is the same as that in the first embodiment or second embodiment.

In the above structure, the operation will be described below. When the centrifugal force dust collection section 18*c* is attached to the cleaner main body 10 and the operation is started, in the same manner as in the above embodiment 1, the suction force of the electric blower 11 acts on a path, from the suction port body 12, through a suction air path 26, the suction air port 19 of the centrifugal force dust collection section 18*c*, the filter 24*c* and the exhaust air port 22 of the centrifugal force dust collection section 18*c*, and by the suction force of the electric blower 11, the dust on the surface to be cleaned scraped up by the rotating brush 17 is sucked-in from the suction port body 12. This sucked dust is introduced into the centrifugal force dust collection section 18 in the tangential direction from the suction air port 19 through the suction air path 26 communicating with the suction port body 12 together with the air.

The air including the dust introduced from the suction air port 19 in the tangential direction is formed into the eddy current along the inner peripheral surface of the centrifugal force dust collection section 18 and moves downward while rotating, and when it is lowered to near the lower end, the flow is turned and begins rising, and rises toward the exhaust air port 22 while rotating at the central portion of the centrifugal force dust collection section 18.

At this time, by the centrifugal force due to the cyclone action, the dust in the air is lowered along the inner wall surface of the dust box 20 constituting the centrifugal force dust collection section 18, and the large dust is accumulated on the bottom portion of the dust box 20, and the fine dust is turned to rise at the almost central portion of the dust box 20 and is adhered to the filter 24*c*, and the high dust collection performance can be obtained for a long period of time.

Further, when the dust box 20 is filled with the dust, only the dust box 20 is taken off, and the dust can be abandoned. In this case, because the filter 24*c* is provided on the cover body 23 so as to cover the exhaust air port 22, the filter 24*c*does not protrude into the dust box 20, therefore, the content volume of the dust box 20 can be increased, the amount of the dust which can be accumulated, can be increased.

(The Fourth Embodiment)

Figure 10:
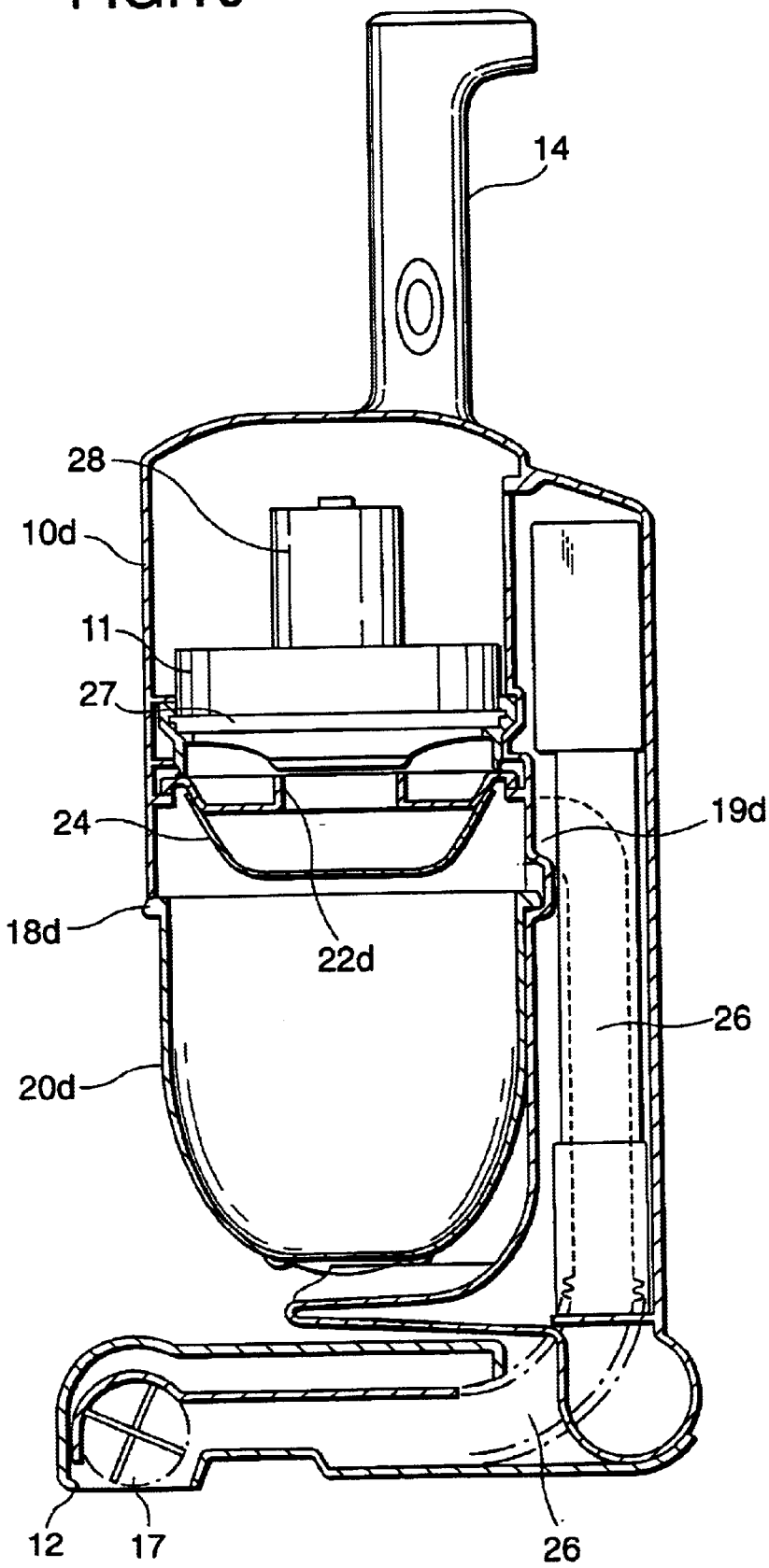
FIG. 10 is a longitudinal sectional view showing a vacuum cleaner according to a fourth embodiment of the present invention.
Figure 11:
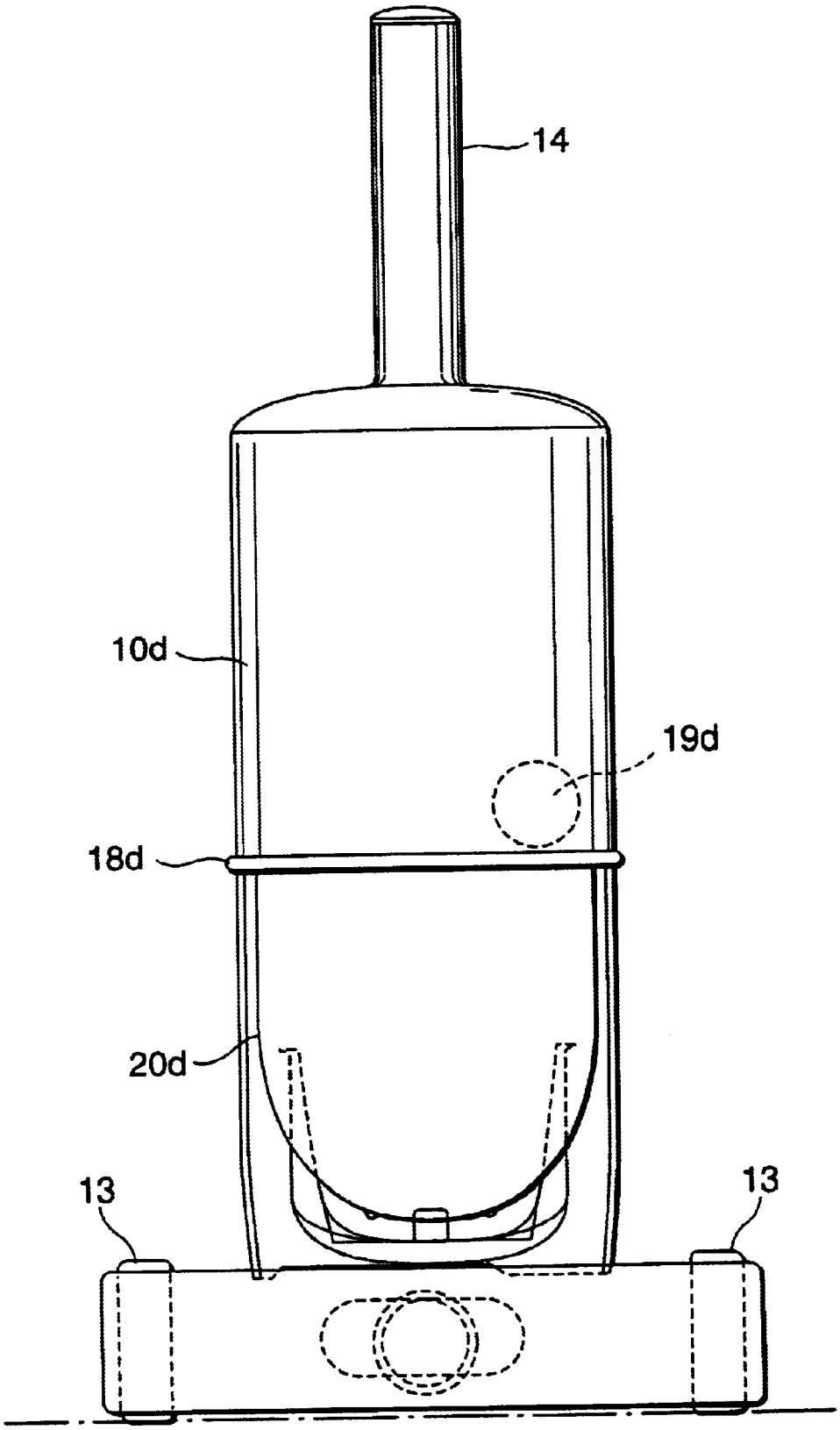
FIG. 11 is a front view showing the vacuum cleaner showing the fourth embodiment of the present invention.
Figure 12:
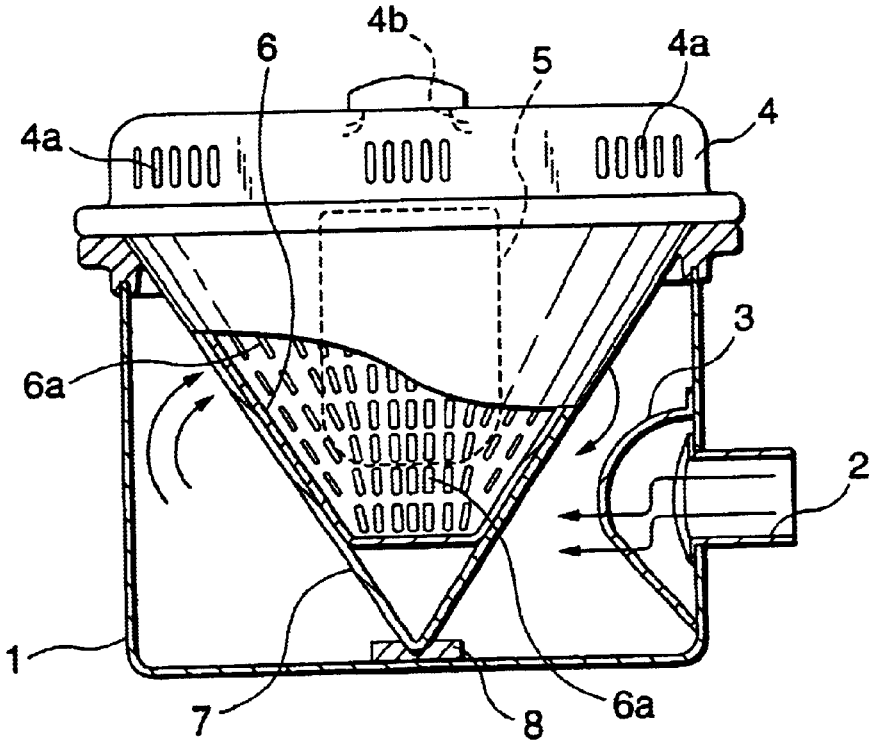
FIG.12 (PRIOR ART)
FIG. 12 is a partially cutout front view showing a centrifugal force dust collection section of the conventional vacuum cleaner.
Figure 13:
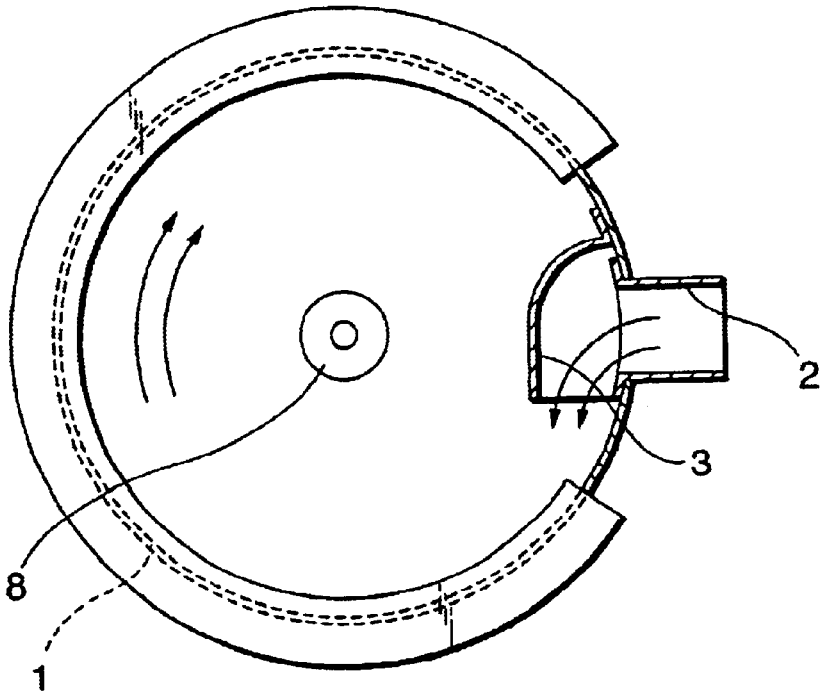
FIG.13 (PRIOR ART)
FIG. 13 is a partially cutout plan view showing a centrifugal force dust collection section of the conventional vacuum cleaner.

Referring to FIGS. 10 and 11, the fourth embodiment of the present invention will be described below. Incidentally, the same part of as that in the above embodiment, is denoted by the same numeral code, and its explanation will be omitted.

A cleaner main body 10*d* is structured such that it houses therein the electric blower 11 which generates the suction force, and the suction port body 12 is provided in the front lower portion. The centrifugal force dust collection section 18*d* collects the dust from the suction port body 12, and is composed of the dust box 20*d* with the bottom, formed into the almost cylindrical shape, and the cleaner main body 10*d* which is in combined use with the cover body to cover the upper opening portion 21 of the dust box 20*d*, and is provided with the suction air port 19*d* and the exhaust air port 22*d*, and a filter 24 is provided on the cleaner main body 10*d* which is in combined use with the cover body to cover the exhaust air port 22, and the dust box 20*d* can be detachably attached to the cleaner main body 10*d*.

When the dust box 20*d* is attached to the cleaner main body 10*d*, the upper opening portion of the dust box 20*d* is brought into pressure-contact with the cleaner main body 10*d*, and these are structured so that these can be air tightly connected to each other. Further, the suction air port 19*d* is connected to a suction air path 26 communicating with the suction port body 12. Other structures are the same as in the above embodiment 1 or 2.

In the above structure, operations will be described below. When the dust box 20*d* is attached to the cleaner main body 10*d* and the operation is started, in the same manner as in the above embodiment 1, the suction force of the electric blower 11 acts in a path, from the suction port body 12, through a suction air path 26, the suction airport 19*d* of the centrifugal force dust collection section 18*d*, the filter 24 and the exhaust air port 22*d* of the centrifugal force dust collection section 18*d*, and by the suction force of the electric blower 11, the dust on the surface to be cleaned scraped up by the rotating brush 17 is sucked in from the suction port body 12. This sucked dust is introduced into the centrifugal force dust collection section 18*d* in the tangential direction from the suction air port 19 through the suction air path 26 communicating with the suction port body 12 together with the air.

The air including the dust introduced from the suction air port 19*d* in the tangential direction is formed into the eddy current along the inner peripheral surface of the centrifugal force dust collection section 18*d* and moves downward while rotating, and when it is lowered to near the lower end, the flow is turned and begins rising, and rises toward the exhaust air port 22*d* while rotating at the central portion of the centrifugal force dust collection section 18*d*.

At this time, by the centrifugal force due to the cyclone action, the dust in the air is lowered along the inner wall surface of the dust box 20*d* constituting the centrifugal force dust collection section 18*d*, and the large dust is accumulated on the bottom portion of the dust box 20*d*, and the fine dust is turned to rise at the almost central portion of the dust box 20 and is adhered to the filter 24, and the high dust collection performance can be obtained for a long period of time.

Further, when the dust box 20*d* is filled with the dust, only the dust box 20*d* is taken off, and the dust can be abandoned. In this case, because the suction air port 19*d* and the exhaust air port 22*d* are provided on the cleaner main body 10*d* side which is in combined use with the cover body, the opening portion such as the suction air port or the exhaust air port is not necessary in the dust box 20*d*. Accordingly, the dust can be accumulated up to the upper end opening portion of the dust box 20*d*, and when the dust is abandoned, because there is no opening portion such as the suction air port or the exhaust air port, in the dust box 20*d*, the dust does not spill from these portions.

Further, even in any of the above-described embodiments, the area of the filter is made larger than the area of the exhaust air port, and the ventilation resistance is reduced while the dust collection portion is downsized.

Also, the provision of the rotating brush which is disposed on the suction port body and driven by the motor or the air turbine enables the dust collection performance on a carpet or the like to be enhanced even by a low-input type electric blower.

As described above, according to the present invention, by driving the fan section by the low input type motor, the centrifugal force dust collection section can be made small in the size and light in the weight, and the low power consumption vacuum cleaner can be obtained, while securing the dust collection performance in the centrifugal force dust collection.

What is claimed is:

1. A vacuum cleaner, comprising:

an electric blower for generating a suction force;

a suction port body for taking in dust on a surface to be cleaned;

a centrifugal force dust collection section to collect the dust from said suction port body, said centrifugal force dust collection section includes a suction air port coupled to said suction port body; and a substantially conically-shaped filter to remove the dust flowing from said centrifugal force dust collection section into said electric blower, said filter being arranged such that a cross-sectional diameter of said filter decreases in a direction toward a bottom of said centrifugal force dust collection section;

wherein said electric blower comprises a fan section and a motor to drive said fan section, wherein said suction air port is arranged and dimensioned so as to guide air tangentially into an inner peripheral surface of said centrifugal force dust collection section, and wherein said vacuum cleaner is configured such that air flows from said centrifugal force dust collection section to said filter without passing through a filter housing wall.

2. The vacuum cleaner according to claim 1, wherein said motor is configured for power input of not larger than 300 W.

3. The vacuum cleaner according to claim 1, wherein said motor is a DC motor.

4. The vacuum cleaner according to claim 1, wherein said motor is driven by a battery.

5. The vacuum cleaner according to claim 4, wherein said battery is a chargeable battery.

6. The vacuum cleaner according to claim 1, wherein dust from the suction port body is introduced into the suction air port, said centrifugal force dust collection section further comprises an exhaust air port communicating with the suction side of the electric blower, wherein said filter covers the exhaust air port.

7. The vacuum cleaner according to claim 6, wherein said centrifugal force dust collection section includes a side wall, said suction air port is provided on the side wall of the centrifugal force dust collection section, and said exhaust air port is provided on an upper portion of said centrifugal force dust collection section.

8. The vacuum cleaner according to claim 7, wherein a lower end portion of said filter is positioned below the suction air port.

9. The vacuum cleaner according to claim 7, wherein a lower portion of said filter overlaps with a portion of the suction air port.

10. The vacuum cleaner according to claim 6, wherein a lower portion of said filter is positioned above the suction air port.

11. The vacuum cleaner according to claim 6, wherein a lower end portion of said filter is positioned below the suction air port.

12. The vacuum cleaner according to claim 6, wherein a lower portion of said filter is positioned at a same height as a portion of the suction air port.

13. The vacuum cleaner according to claim 1, further comprising an exhaust air port, wherein the surface area of the filter is not smaller than the area of the exhaust air port.

14. The vacuum cleaner according to claim 1, wherein a rotating brush which is driven by a motor or an air turbine is provided on said suction port body.

15. The vacuum cleaner according to claim 1, wherein said suction air port is positioned off-center relative to a central axis of said centrifugal force dust collection section.

16. The vacuum cleaner according to claim 1, wherein said suction air port is located closer to a top end of said centrifugal force dust collection section than a bottom end of said centrifugal force dust collection section.

17. A vacuum cleaner, comprising:

an electric blower for generating a suction force;

a suction port body for taking in dust on the surface to be cleaned;

a centrifugal force dust collection section to collect the dust from said suction port body;

an exhaust air path to guide at least part of exhaust air of said electric blower to said suction port body; and a suction air path for taking the dust from the suction port body to the centrifugal force dust collection section, wherein said electric blower comprises a fan section and a motor to drive said fan section, wherein the suction air path and the exhaust air path communicate with each other at the suction port body.

18. The vacuum cleaner according to claim 17, wherein said motor is configured for power input of not larger than 200 W.

19. The vacuum cleaner according to claim 17, wherein said motor is configured for power input of not larger than 300 W.

20. The vacuum cleaner according to claim 17, further comprising a filter to remove the dust flowing from said centrifugal force dust collection section into said electric blower.

21. The vacuum cleaner according to claim 17, wherein said motor is a DC motor.

22. The vacuum cleaner according to claim 17, wherein said motor is driven by a battery.

23. The vacuum cleaner according to claim 22, wherein said battery is a chargeable battery.

24. The vacuum cleaner according to claim 17, wherein said centrifugal force dust collection section comprises a suction air port into which the dust from the suction port body is introduced, and an exhaust air port communicating with the suction side of the electric blower, and a filter to cover the exhaust air port is provided.

25. The vacuum cleaner according to claim 24, wherein said centrifugal force dust collection section includes a side wall, said suction air port is provided on the side wall of the centrifugal force dust collection section, and said exhaust air port is provided on an upper portion of said centrifugul force dust collection section.

26. The vacuum cleaner according to claim 25, wherein a lower portion of said filter is positioned above the suction air port.

27. The vacuum cleaner according to claim 25, wherein a lower end portion of said filter is positioned below the suction air port.

28. The vacuum cleaner according to claim 25, wherein a lower portion of said filter overlaps with a portion of the suction air port.

29. The vacuum cleaner according to claim 24, wherein a lower portion of said filter is positioned above the suction air port.

30. The vacuum cleaner according to claim 24, wherein a lower end portion of said filter is positioned below the suction air port.

31. The vacuum cleaner according to claim 24, wherein a lower portion of said filter overlaps with a portion of the suction air port.

32. The vacuum cleaner according to claim 17, wherein said centrifugal force dust collection section comprises a dust box with a bottom provided with a suction air port, and a cover body covering an upper opening portion of said dust box and provided with an exhaust air port, and the upper opening portion is covered by a filter.

33. The vacuum cleaner according to claim 17, wherein said centrifugal force dust collection section comprises a dust box with a bottom provided with a suction air port, and a cover body covering an upper opening portion of said dust box, and the cover body is provided with an exhaust air port, and a filter is provided on the cover body so as to cover the exhaust air port.

34. The vacuum cleaner according to claim 17, wherein said centrifugal force dust collection section comprises a dust box with a bottom, and a cover body covering an upper opening portion of said dust box, and said cover body is provided with a suction air port and an exhaust air port, and a filter is provided on the cover body so as to cover the exhaust air port.

35. The vacuum cleaner according to claim 17, further comprising a filter and an exhaust air port, wherein the surface area of the filter is not smaller than the area of the exhaust air port.

36. The vacuum cleaner according to claim 17, wherein a rotating brush which is driven by a motor or an air turbine is provided on said suction port body.

37. The vacuum cleaner according to claim 17, wherein said centrifugal force dust collection section includes a suction air port coupled to said suction port body, said suction air port is arranged and dimensioned so as to guide air tangentially into an inner peripheral surface of said centrifugal force dust collection section.

38. The vacuum cleaner according to claim 37, wherein said suction air port is positioned off-center relative to a central axis of said centrifugal force dust collection section.

39. The vacuum cleaner according to claim 37, wherein said suction air port is located closer to a top end of said centrifugal force dust collection section than a bottom end of said centrifugal force dust collection section.

40. A vacuum cleaner, comprising:

an electric blower for generating a suction force;

a suction port body for taking in dust on a surface to be cleaned;

a centrifugal force dust collection section to collect the dust from said suction port body, said centrifugal force dust collection section includes a suction air port coupled to said suction port body; and a substantially conically-shaped filter to remove the dust flowing from said centrifugal force dust collection section into said electric blower, said filter being arranged such that a cross-sectional diameter of said filter decreases in a direction toward a bottom of said centrifugal force dust collection section;

wherein said electric blower comprises a fan section and a motor to drive said fan section, wherein said suction air port is arranged and dimensioned so as to guide air tangentially into an inner peripheral surface of said centrifugal force dust collection section, and wherein said centrifugal force dust collection section comprises a dust box provided with the suction air port, and a cover body covering an upper opening portion of said dust box and provided with an exhaust air port, and the upper opening portion is covered by said filter.

41. A vacuum cleaner, comprising:

an electric blower for generating a suction force;

a suction port body for taking in dust on a surface to be cleaned;

a centrifugal force dust collection section to collect the dust from said suction port body, said centrifugal force dust collection section includes a suction air port coupled to said suction port body; and a substantially conically-shaped filter to remove the dust flowing from said centrifugal force dust collection section into said electric blower, said filter being arranged such that a cross-sectional diameter of said filter decreases in a direction toward a bottom of said centrifugal force dust collection section;

wherein said electric blower comprises a fan section and a motor to drive said fan section, wherein said suction air port is arranged and dimensioned so as to guide air tangentially into an inner peripheral surface of said centrifugal force dust collection section, and wherein said centrifugal force dust collection section comprises a dust box provided with the suction air port, and a cover body covering an upper opening portion of said dust box, and the cover body is provided with an exhaust air port, and said filter is provided on the cover body so as to cover the exhaust air port.

42. A vacuum cleaner, comprising:

an electric blower for generating a suction force;

a suction port body for taking in dust on a surface to be cleaned;

a centrifugal force dust collection section to collect the dust from said suction port body, said centrifugal force dust collection section includes a suction air port coupled to said suction port body; and a substantially conically-shaped filter to remove the dust flowing from said centrifugal force dust collection section into said electric blower, said filter being arranged such that a cross-sectional diameter of said filter decreases in a direction toward a bottom of said centrifugal force dust collection section;

wherein said electric blower comprises a fan section and a motor to drive said fan section, wherein said suction air port is arranged and dimensioned so as to guide air tangentially into an inner peripheral surface of said centrifugal force dust collection section, and wherein said centrifugal force dust collection section comprises a dust box, and a cover body covering an upper opening portion of said dust box, and said cover body is provided with the suction air port and an exhaust air port, and said filter is provided on the cover body so as to cover the exhaust air port.

43. A vacuum cleaner, comprising:

an electric blower for generating a suction force;

a suction port body for taking in dust on a surface to be cleaned;

a centrifugal force dust collection section to collect the dust from said suction port body, said centrifugal force dust collection section includes a suction air port coupled to said suction port body; and a substantially conically-shaped filter to remove the dust flowing from said centrifugal force dust collection section into said electric blower, said filter being arranged such that a cross-sectional diameter of said filter decreases in a direction toward a bottom of said centrifugal force dust collection section;

wherein said electric blower comprises a fan section and a motor to drive said fan section, wherein said suction air port is arranged and dimensioned so as to guide air tangentially into an inner peripheral surface of said centrifugal force dust collection section, wherein dust from the suction port body is introduced into the suction air port, said centrifugal force dust collection section further comprises an exhaust air port communicating with the suction side of the electric blower, wherein said filter covers the exhaust air port, wherein said centrifugal force dust collection section includes a side wall, said suction air port is provided on the side wall of the centrifugal force dust collection section, and said exhaust air port is provided on an upper portion of said centrifugal force dust collection section, and wherein a lower portion of said filter is positioned above the suction air port.

* * * * *